US006688575B2

(12) United States Patent
Cirrincione

(10) Patent No.: US 6,688,575 B2
(45) Date of Patent: Feb. 10, 2004

(54) CANE STAND

(76) Inventor: Jerome D. Cirrincione, HCR 74, Box 97, Whiting, ME (US) 04691

( * ) Notice: Subject to any disclaimer, the term of this patent is extended or adjusted under 35 U.S.C. 154(b) by 51 days.

(21) Appl. No.: 10/074,764

(22) Filed: Mar. 14, 2002

(65) Prior Publication Data

US 2003/0173486 A1 Sep. 18, 2003

(51) Int. Cl.[7] ..... E16M 11/10

(52) U.S. Cl. ..... 248/519; 521/523; 521/524; 521/398

(58) Field of Search ..... 248/155, 155.5, 248/371, 398, 127, 519, 521, 523, 524, 525, 443

(56) References Cited

U.S. PATENT DOCUMENTS

| | | | | | |
|---|---|---|---|---|---|
| 96,745 | A | * | 11/1869 | Twamley | |
| 114,845 | A | * | 5/1871 | Nellis | |
| 1,711,730 | A | | 5/1929 | Gibson | |
| 2,127,976 | A | * | 8/1938 | —Howat | 135/47 |
| 2,500,215 | A | * | 3/1950 | Swearingen | 248/46 |
| 2,548,711 | A | * | 4/1951 | Embrey | 248/155 |
| 2,910,995 | A | * | 11/1959 | Jacuzzi | 135/62 |
| 3,119,585 | A | * | 1/1964 | Austenson | 248/44 |
| 3,392,946 | A | | 7/1968 | Stromberg | 248/171 |
| 3,532,309 | A | * | 10/1970 | Reddick | 248/42 |
| 4,091,828 | A | * | 5/1978 | Jorgensen | 135/66 |
| 5,456,437 | A | | 10/1995 | Chander et al. | 248/316.7 |
| 5,852,250 | A | * | 12/1998 | Cha | 84/327 |
| 6,005,176 | A | * | 12/1999 | Yu | 84/327 |
| 6,209,829 | B1 | * | 4/2001 | Yu | 248/122.1 |
| 6,311,942 | B1 | * | 11/2001 | Rotter et al. | 248/316.5 |

* cited by examiner

*Primary Examiner*—Korie Chan
*Assistant Examiner*—Steven Marsh
(74) *Attorney, Agent, or Firm*—Brown & Michaels, PC

(57) ABSTRACT

A cane stand for storing a cane. The cane stand is made up of a base pivotally attached to a shaft at one end and a clip pivotally mounted opposite from the end pivotally mounted to the base. Another clip is fixedly attached to the end of the shaft that is adjacent to the base. Both clips receive portions of the cane to be stored. When the cane is stored in a vertical position, the cane fits into a cutout in the base.

6 Claims, 3 Drawing Sheets

CANE STAND

BACKGROUND OF THE INVENTION

1. Field of the Invention

The invention pertains to the field of portable holders for canes. More particularly, the invention pertains to a holder that temporarily engages the shaft of a cane to store the cane in an upright position.

2. Description of Related Art

Canes are used by a large percentage of the population. One of the problems associated with canes is storage. Often times, the cane has to be hung off of a table where any activity around the cane can cause it to fall or be put far out of reach, making the cane inaccessible when the person first gets up. Furthermore, it is very difficult to compactly store a cane in an upright is very difficult to compactly store a cane in an upright position. For example, when a person is out in public, for example in a restaurant a person usually has to store their cane either under their chair, on another chair not being used, against a wall, far out of reach, or hung off the table, so as not to block a path for the other patrons of the restaurant or the wait staff.

Various solutions have been proposed for storing a cane in an upright, vertical position. For example, U.S. Pat. No. 3,392,946 (Stromberg) discloses a self standing device comprising a housing with a plurality of movable legs, and an extending/retracting means adapted to readily secure to the lower end of a cane, crutch, or the like. Another example is U.S. Pat. No. 5,456,437 (Chander et. al.), which discloses a clamp forming part of a vertical member that is pivotally attached to a flat plane, where the clamping portion holds the shaft of a cane, crutch or the like, in a temporary fixed position, with the cane, crutch, or the like resting on the floor. The invention also includes a plate with a non-skid surface, which pivots so that it can be placed on a horizontal surface such as a tabletop or bench and the back of the vertical member can still holds the cane, crutch, or the like in a vertical position.

SUMMARY OF THE INVENTION

A portable, cane stand for compactly storing a cane. The cane stand comprises a base, a shaft pivotally mounted to the base at an end so that the shaft can pivot relative to the base, and a clip pivotally mounted to an end opposite of the base. Another clip is fixedly attached to the end of the shaft adjacent to the base. Both clips present in the cane stand receive a portion of the cane to be stored. The clips may have a rubber sheathing so that the cane's finish is not damaged when the cane is being stored in the cane stand. The pivots of the cane stand are an assembly comprising a ferrule securably mounted to the shaft, a hinge, and a mounting for clip. When the cane is being stored in a vertical position, the cane is received by both of the clips and fits into a cutout present in the base.

DETAILED DESCRIPTION OF THE INVENTION

The storage of canes is a problem in that the storage is often not present where the person is sitting and it is not compact. The present invention is a lightweight, portable, and compact, cane holder.

Figure 1:
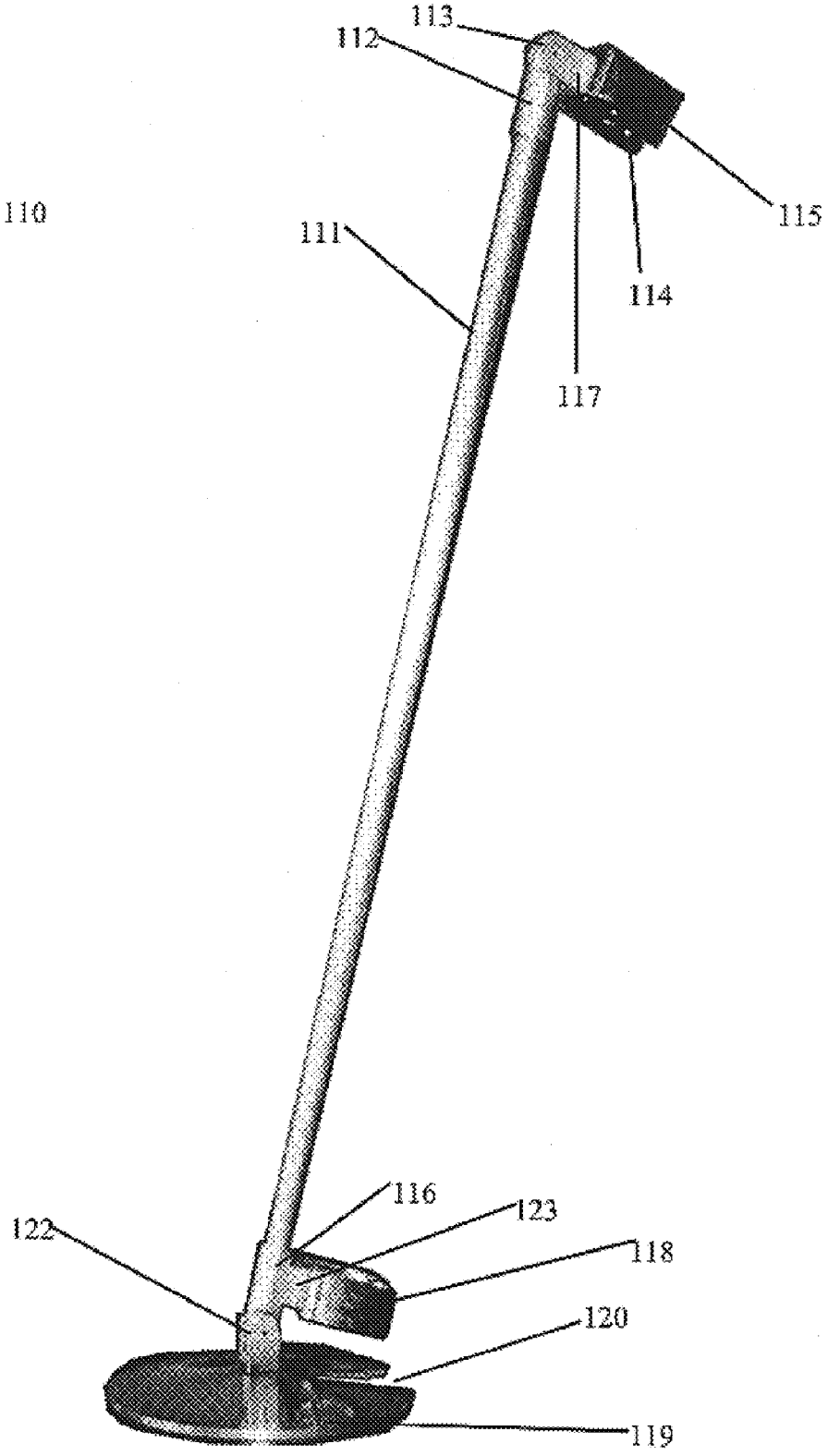
FIG. 1 shows a side view of the present invention.
Figure 2:
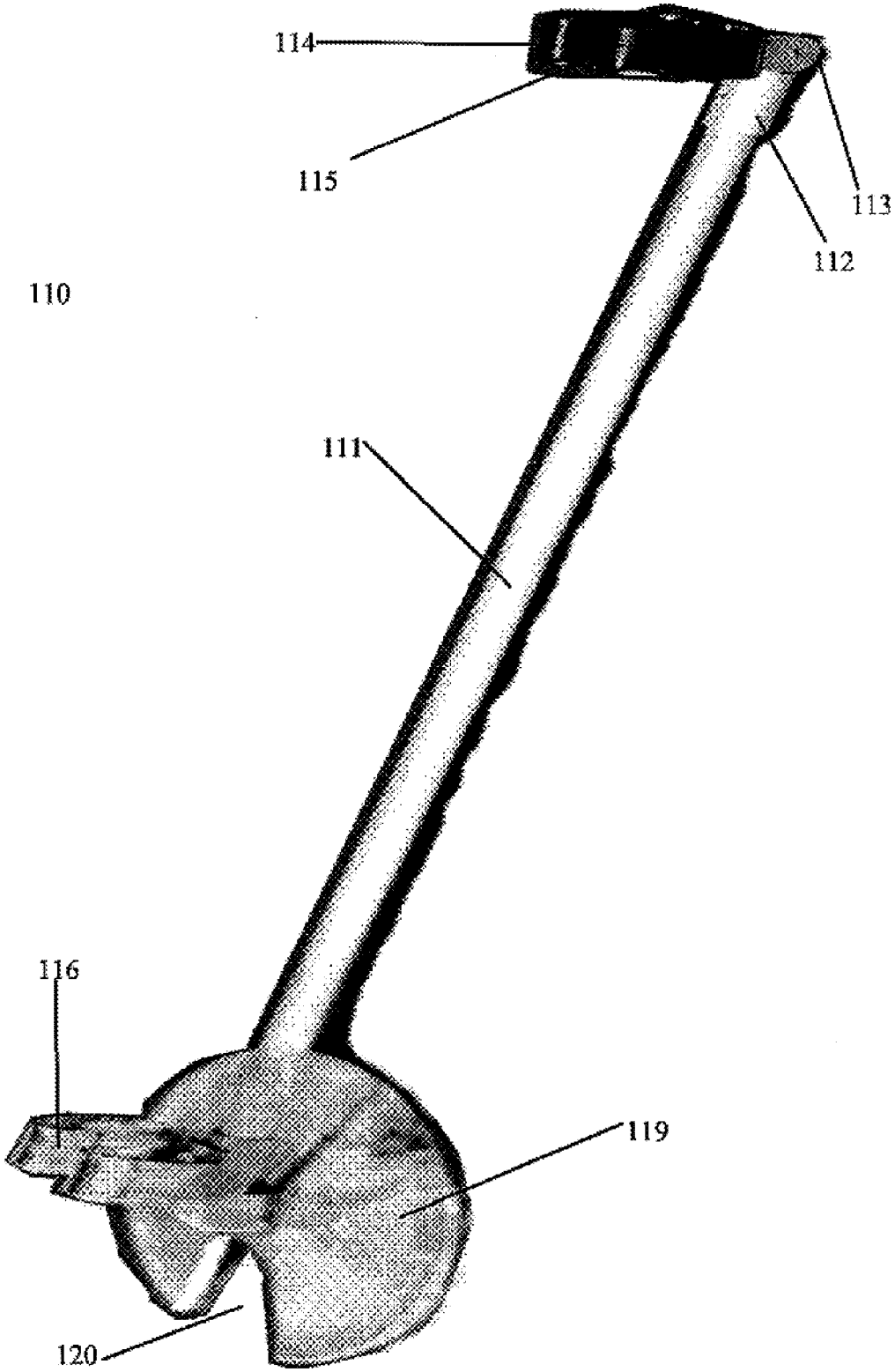
FIG. 2 shows a top down view of the present invention.
Figure 3:
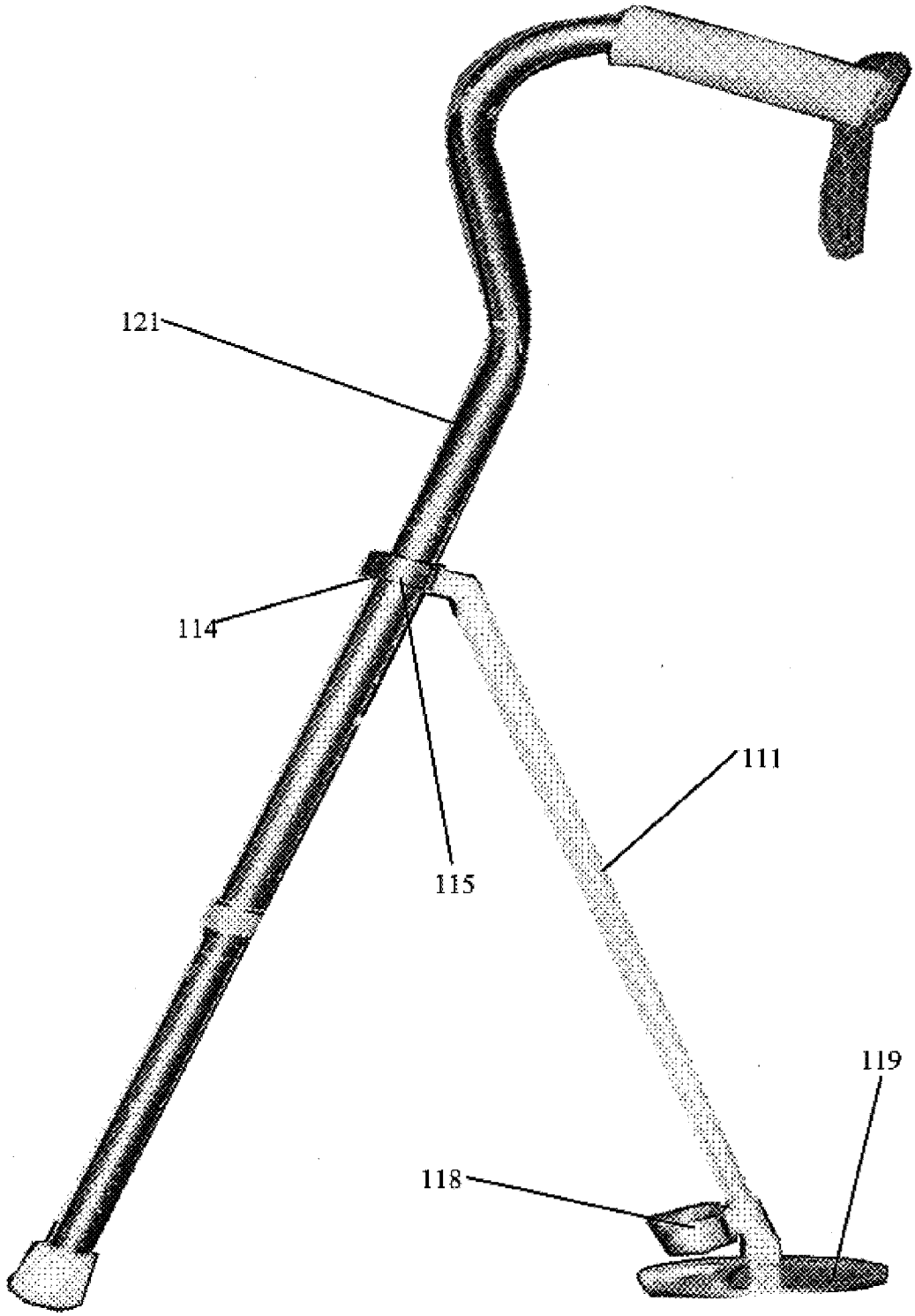
FIG. 3 shows the present invention storing a cane.

FIGS. 1, 2, and 3 show different views of the cane stand (110). The cane stand (110) is made up of a base (119) that contains a cutout (120), a shaft (111) pivotally mounted to the base (119) at one end so that the shaft (111) may pivot on an axis relative to the base (119), and two spring clips (114, 118) (the clips may be of the kind manufactured by Gibson Tool Co., as shown in U.S. Pat. No. 1,711,730). The size of the clips may be varied to accommodate various cane sizes. Similarly, the length of the shaft (111) may be varied as desired to support canes of differing sizes.

One of the clips (114) is pivotally attached to an end of the shaft (111) opposite of the base (119) and may pivot on an axis relative to the base (119). The other clip (118) is securably attached to the end of the shaft (111) adjacent to the base (119), more specifically, to a ferrule (116). The clips (114, 118) can contain a rubber sheathing (115) to prevent damage to the finish of the cane (121) being stored. The clip (114) and the shaft (111) are pivotally mounted to the shaft (111) and the base (119) respectively by pivot assemblies. Each pivot assembly is made up of a ferrule (112, 116) securably attached to the shaft (111), a hinge (113, 122), and a mounting (117, 123) for a clip (114). Two pivot assemblies are present in each cane stand (110), one at the end pivotally mounted to the base (119) and one at the end pivotally mounted to one of the spring clips (114).

The cane stand (110) can store a cane (121) in many different upright positions. For example, the cane (121) can be stored completely parallel to the cane stand (110), in which both spring clips (114, 118) are used to receive the cane (121) and the cane (121) fits into a cutout (120) present on the base (119). The cane (121) can also be stored in a manner similar to FIG. 3, where the cane (121) is at an angle to the cane stand (110) and only the clip (114) pivotally mounted to the shaft (111) receives the cane (121).

When the cane stand is in use, the user can vary the height at which the cane is supported by changing the point along the length of the cane at which the spring clip (114) is attached.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A clip-on stand for a cane comprising:

a) a base plate having a cutout for receiving an end of a cane;

b) a shaft having a first end and a second end, the shaft being pivotally mounted to a middle portion of the base at the first end;

c) a spring clip pivotally mounted to the first end of the shaft; and d) a spring clip pivotally mounted to the second end of the shaft, wherein when the shaft is attached to the cane by fastening the spring clip mounted to the second end of the shaft to the cane, the shaft may pivot on an axis relative to the base, and when the shaft is pivoted, such that the shaft makes an acute angle from the cane, and the base and an end of the cane are placed on a supporting surface, the cane is supported by the end of the cane and the base of the clip-on stand.

2. The cane stand of claim 1, wherein the spring clip has a rubber sheathing to protect the cane being stored.

3. The cane stand of claim 1, wherein the shaft is pivoted parallel to the cane, such that the cane fits in the cutout of the base.

4. The cane stand of claim 1, in which the shaft is pivotally mounted to the base at a first end by a pivot assembly comprising:

a) a ferrule securably mounted to the first end of the shaft;

b) a hinge mounted to the ferrule; and c) a mounting for the spring clip coupled to the hinge.

5. The cane stand of claim 1, in which the spring clip is pivotally mounted to the second end of the shaft by a pivot assembly comprising a) a ferrule securably mounted to the second end of the shaft b a hinge mounted to the ferrule; and c) a mounting for the spring clip coupled to the hinge.

6. The cane stand of claim 1, wherein the spring clip is fixedly attached to the first end of the shaft adjacent to the base.

* * * * *